United States Patent [19]

Ward et al.

[11] 4,169,022

[45] Sep. 25, 1979

[54] ELECTROLYTIC FORMATION OF CHROMITE COATINGS

[75] Inventors: John J. B. Ward; Clive Barnes, both of Wantage, England

[73] Assignee: BNF Metals Technology Centre, Oxon, England

[21] Appl. No.: 908,236

[22] Filed: May 22, 1978

[30] Foreign Application Priority Data

May 24, 1977 [GB] United Kingdom ..... 21869/77

[51] Int. Cl.[2] ..... C25D 11/00

[52] U.S. Cl. ..... 204/56 R; 204/38 R

[58] Field of Search ..... 204/56 R, 38 R; 148/6.2, 6.21

[56] References Cited

U.S. PATENT DOCUMENTS 3,032,487 5/1962 Yonezaki et al. ..... 204/56 R

FOREIGN PATENT DOCUMENTS 1179021 1/1970 United Kingdom ..... 204/56 R

*Primary Examiner*—R. L. Andrews

*Attorney, Agent, or Firm*—Wenderoth, Lind & Ponack

[57] ABSTRACT

A method of depositing a protective chromite conversion coating is described. The chromite coatings produced by the method contain no $Cr^{VI}$. The electrolyte used in the method comprises $Cr^{III}$ ions in a concentration of not more than 1 molar and a weak complexing agent for $Cr^{III}$ ions. The electrolyte, preferably, also contains conductivity salts. The method involves using a cathode current density of not more than 2000 amps per square meter and a temperature of not more than 35° C. for a period of not more than 3 minutes. The chromite conversion coatings can be improved by aging and can be subsequently painted or lacquered. The $Cr^{III}$ electrolytes used are much less corrosive than $Cr^{VI}$ electrolytes and thus the substrates which can be coated include materials which cannot readily be chromate coated because they are reactive towards $Cr^{VI}$ electrolytes.

9 Claims, No Drawings

ELECTROLYTIC FORMATION OF CHROMITE COATINGS

The present invention relates to the deposition of corrosion resistant coatings on metal substrates and particularly to a method of depositing protective coatings containing $Cr_2O_3$.

It is known that protective layers of chromium oxides can be electrodeposited onto metal substrates to improve corrosion resistance. Such layers are known as chromium conversion coatings. At present the production of chromium containing conversions coatings is carried out under acid conditions from a $Cr^{VI}$ electrolyte containing sulphuric or nitric acids. Sulphuric acid gives yellow coatings and nitric acid colourless or slightly blue coatings; however, the coatings deposited from sulphuric acid are more corrosion resistant than the nitric acid ones. These coatings contain $Cr^{VI}$ and are also known as 'chromate' coatings.

We have previously shown that it is possible to electrodeposit highly satisfactory layers of chromium from trivalent chromium electrolytes. We have now found that by deliberately suppressing the deposition of chromium metal from a $Cr^{III}$ electrolyte it is possible to deposit non-metallic layers of $Cr^{III}$ oxide having both excellent transparency and corrosion resistance. We refer to such coatings as 'chromite' coatings or deposits and as used herein the term 'chromite' refers to such coatings and deposits containing no $Cr^{VI}$.

The present invention accordingly provides a method of depositing a protective chromite layer on a substrate which method comprises providing an anode and as a cathode the substrate to be coated in an electrolyte comprising $Cr^{III}$ ions in a concentration of not more than 1 molar and a weak complexing agent for $Cr^{III}$ ions, and passing an electric current between the anode and cathode at a cathode current density of not more than 2000 amps per square meter, and a temperature of not more than 35° C. for a period of not more than 3 minutes whereby a protective chromite layer is deposited on the cathode.

The electrolytes used in the present invention closely resemble electrolytes used to deposit Cr metal. They differ in that they generally do not include substances which promote Cr metal deposition and they are operated under conditions which favour chromite deposition in preference to metal deposition.

The concentration of $Cr^{III}$ ions in the electrolyte will generally be at least 0.02 molar (1 $gl^{-1}$ as Cr). However, with less than 0.1 molar (5 $gl^{-1}$) chromite deposition cannot be effected reliably and this concentration represents a practically useful minimum. There is a specific upper limit in that at concentrations higher than 1 molar chromium metal tends to be deposited even at low current densities. Preferably the concentration is not higher than 0.6 molar, in order to have a relatively wide current density range. The optimum concentration within this range will depend on the precise operating conditions, and the practical economic optimum will generally be a compromise between maximum deposition rate favoured by relatively higher concentrations, and undesired chromium metal deposition, capital cost and losses such as dragout losses which favour lower concentrations.

As the term is used in this invention, a weak complexing agent is one which forms a co-ordination complex with $Cr^{III}$ ions sufficiently strong to maintain the chromium in solution in the electrolyte but not so strongly that deposition of chromium particularly as a chromite deposit under the influence of an electric current is prevented. The nature of weak complexing agent is not especially critical. Exemplary materials are hypophosphite, glycine, gluconolactone, glycollic acid, acetate, citrate and formate. The aprotic buffers such as dimethylformamide which are useful in chromium metal electrodeposition systems are not generally useful in the present invention because they act to favour the deposition of chromium metal rather than chromite coatings. The amount of the weak complexing agent is sufficient to keep the $Cr^{III}$ in solution. The concentration of the complexant should not be less than 0.5 times that of the $Cr^{III}$ on a molar basis because lower concentrations are generally inadequate to keep $Cr^{III}$ in solution during electrolysis, and is preferably not more than 6 times that of the $Cr^{III}$ (on a molar basis) because there is little if any improvement in performance and the cost is increased. The preferred concentration is within the molar ratio of complexant to $Cr^{III}$ of 0.5:1 to 3:1 with the precise optimum for any particular system depending on the complexing agent used.

It is preferred to ensure that the conductivity of the electrolyte is high since this reduces ohmic losses. To this end conductivity salts may be added to the electrolyte. Suitable salts include those containing cations such as $NH_4^+$, $K^+$, $Na^+$, $Mg^{2+}$ and $Ca^{2+}$, and anions such as halide, especially $Cl^-$ and $SO_4^{2-}$. The concentration used clearly depends on solubility but as a general rule a practical minimum concentration is 0.5 molar and the maximum is limited by saturation solubility and in practice is about 6 molar. However, especially where ammonium chloride and/or sulphate are used as conductivity salts higher concentrations are possible. The preferred range of concentrations of the conductivity salts is from 2 to 6 molar.

The anion present in the electrolyte will, as indicated above, usually be halide and/or sulphate. The anion may be uniform of a mixture e.g. of chloride and sulphate. Generally halides (chlorides) are more soluble but sulphates, especially chromic sulphate, more readily available. We have found that use of mixed anion electrolytes can have an exhalting effect on Cr metal deposition and it is thus preferred to have a common anion.

The anode used in the electrolysis is not critical. Carbon anodes and other inert anodes are generally satisfactory and it is possible to use chromium anodes. With carbon anodes in chloride electrolytes it is desirable to agitate e.g. mechanically or by sparging air, the electrolyte in the vicinity of the anode to assist in suppressing evolution of chlorine at the anode. Active anodes such as lead anodes should be avoided since oxidative reactions generating $Cr^{VI}$ may occur which alter the mode of operation of the electrolyte.

The pH of operation of the electrolytes is generally from 1 to 6 which is very similar to that used in Cr electrodeposition from $Cr^{III}$ electrolytes. To maximise the plating range and in particular to favour chromite deposition rather than chromium metal deposition the pH is preferably more than 3 which is higher than is normal for Cr metal deposition. The current density range is reduced at lower pH's. We have been able to deposit clear chromite films at current densities up to 1200 $Am^{-2}$ under optimum conditions and we believe this reprsents about the practical upper limit of operation to produce clear films. However, if some lack of clarity in the film can be tolerated than current densities up to 2000 $Am^{-2}$ can be used. Some electrolytes and operating conditions give rise to more restricted ranges particularly at the high current density end. At current densities within this range and using electrolysis times typically of from 10 seconds to 3 minutes chromite coatings from 100 Angstroms to 1.0 microns thick can be deposited. Preferably the conditions are adjusted to give a thickness of from 0.025 to 1 and optimally from 0.1 to 1 micron. The minimum thickness of any deposit depends on the shape of the article as reflected in the localised current density together with the period of time of the electrolysis. With electrolysis times greater than 3 minutes chromium metal tends to be deposited, the films becoming progressively less clear until the composition of the deposit is metallic.

Although it is possible, it is not preferred to use boric acid in the electrolytes used in this invention because it has an exhaltant effect on Cr metal deposition. Similarly other chromium metal plating exhaltants such as fluoride ion are preferably absent.

The substrates which can usefully be coated according to the invention are basically the same as those which are conventionally treated in $Cr^{VI}$ systems. However, the present invention makes use of electrolytes which are markedly less corrosive than typical $Cr^{VI}$ electrolytes and it thus becomes possible to coat substrates which would be too susceptible to corrosion in a $Cr^{VI}$ electrolyte. Typical substrates include steel, especially tin-free steel, zinc, brass, copper, nickel, tin, alloyed gold (pure gold being sufficiently corrosion resistant not to require coating), silver, cadmium, chromium, especially sealing porous electrodeposits, stainless steel, especially coloured stainless steel, and possibly cobalt and aluminium (although it is more usual to anodise Al).

Freshly deposited films are often slightly porous and easily removed from the substrate by mild abrasion. Air drying at ambient temperature for not less than 24 hours seals the films causing structural changes which also harden the films making them more resistant to mechanical abrasion. These beneficial sealing effects can be accelerated by drying at super-ambient temperatures but if the temperature is allowed to exceed 75° C. the films can become brittle which lessens their protective value.

The clear films of this invention when deposited on the abovementioned substrates may also serve as a primer coating for the deposition of subsequent coatings of paint or lacquer. The oxide film secures enhanced adhesion of the paint or lacquer coating. Moreover, the oxide film provides additional protection against corrosion by suppressing underfilm corrosion of paint or lacquer layers.

The following examples illustrate the invention.

EXAMPLE 1

An electrolyte was made up as set out below and a Hull Cell panel was plated.

0.4M Cr as sulphate
1.0M sodium hypophosphite
pH=3.0
Temp. 28° C.
Plating time 1 minute
5A Hull Cell panel at 12V Film produced up to 1200 $Am^{-2}$. Thin film of chromium metal above this value.

EXAMPLE 2

As Example 1 with 100 g/l K Cl.

5A Hull Panel at 9V otherwise identical with Example 1.

EXAMPLE 3

As Example 1 with 3M ammonium chloride 5A Hull Cell panel at 8V.

Film produced up to 800 $Am^{-2}$ substantial chromium metal deposition above this value.

EXAMPLE 4

As Example 1 but pH=4.5.

Film produced up to 2000 $Am^{-2}$.

EXAMPLE 5

As Example 1 but electrolysis time 3 minutes. Clear film produced up to 750 $Am^{-2}$ evidence of chromium above this value.

EXAMPLE 6

An electrolyte was made up having the following composition:

0.4M Cr $Cl_3.6H_2O$
2.0M glycine

A Hull Cell panel was plated giving the following results:

pH=3.5
temperature 25° C.

Clear film produced up to 1200 $Am^{-2}$ evidence of chromium metal deposition above this value.

EXAMPLE 7

An electrolyte was made up having the following composition:

0.4M Cr $Cl_3.6H_2O$
1.0M sodium formate
1.5M potassium chloride
pH=3.8
temperature 25° C.
5A Hull Cell panel for 1 minute at 6V Film produced up to 1200 $Am^{-2}$ chromium deposition above this value.

EXAMPLE 8

With an electrolyte of Example 1, copper panels were cathodically treated at 200 $Am^{-2}$ for 30 seconds. Immersion in polysulphide solutions caused the copper to slowly blacken. Other copper panels cathodically treated in the same way were oven-dried at 50° C. for 16 hours. No blackening occurred when immersed in a polysulphide solution.

EXAMPLE 9

Copper panels were cathodically treated in an electrolyte of Example 1 at a current density of 200 $Am^{-2}$ for a time of 1 minute. After drying, the panels were sprayed with a clear lacquer. When the lacquer was dry one panel was cut in half. Examination showed that there was no flaking of the lacquer along the edges of the cut. For comparison, a copper panel was sprayed directly with lacquer. After cutting in half, some microflaking of the lacquer was detected.

Other copper panels, prepared as described above, were scribed to give a single long scratch penetrating to the copper. The panels were exposed to a humid, corrosive environment. After one month panels with the cathode film plus lacquer only showed corrosion along the length of the scratch. Lacquered panels without the cathode film showed corrosion spreading from scratch underneath the lacquer.

We claim:

1. A method of depositing a protective chromite layer on a substrate comprising providing an anode and as a cathode the substrate to be coated in an electrolyte comprising $Cr^{III}$ ions in a concentration of not more than 1 Molar and a weak complexing agent for $Cr^{III}$ ions and passing an electric current between the anode and cathode at a cathode current density of not more than 2000 amps per square meter and a temperature of not more than 35° C. for a period of not more than 3 minutes.

2. A method as claimed in claim 1 wherein the electrolyte contains one or more conductivity salts.

3. A method as claimed in claim 2 wherein the conductivity salt or salts include at least one cation selected from the group consisting of $NH_4^+$, $Na^+$, $K^+$, $Mg^{2+}$ and $Ca^{2+}$ ions, and at least one anion selected from the group consisting of halide and sulphate ions.

4. A method as claimed in claim 1 wherein the concentration of $Cr^{III}$ ions in the electrolyte is at least 0.02 molar.

5. A method as claimed in claim 1 wherein the concentration of the $Cr^{III}$ ions in the electrolyte is from about 0.1 to about 0.6 molar.

6. A method as claimed in claim 1 wherein the weak complexing agent is selected from the group consisting of hypophosphite, glycine, gluconolactone, glycollic acid, acetate and formate.

7. A method as claimed in claim 1 wherein the molar ratio of the concentration of the complexing agent to $Cr^{III}$ ions is from 0.5:1 to 3:1.

8. A method as claimed in claim 1 wherein the current density is up to 1200 $Am^{-2}$.

9. A method as claimed in claim 1 wherein the substrate to be coated is of steel, zinc, brass, copper, nickel, tin, alloyed gold, silver, cadmium, chromium, stainless steel, cobalt or aluminium.

* * * * *